United States Patent [19]

Drake

[11] Patent Number: 4,934,740

[45] Date of Patent: Jun. 19, 1990

[54] RECORD BOOK OR PAD

[75] Inventor: Thomas R. Drake, Epsom Downs, Great Britain

[73] Assignee: Tom Drake Associates Limited, Surrey, England

[21] Appl. No.: 295,605

[22] Filed: Jan. 10, 1989

[30] Foreign Application Priority Data

Jan. 12, 1988 [GB] United Kingdom ..... 8800613

[51] Int. Cl.[5] ..... B41L 1/24

[52] U.S. Cl. ..... 282/8 R; 281/16; 412/1

[58] Field of Search ..... 282/8 R; 281/16; 283/50, 51, 52, 52.1

[56] References Cited

U.S. PATENT DOCUMENTS 586,925 7/1897 Lozano ..... 282/8 R
685,151 10/1901 Landing ..... 282/8 R
4,533,160 8/1985 Malone ..... 282/8 R X
4,714,276 12/1987 Greig ..... 281/16 X
4,798,401 1/1989 Greig ..... 282/9 R

*Primary Examiner*—Hien H. Phan
*Assistant Examiner*—Eugenia A. Jones

[57] ABSTRACT

A record book or pad is manufactured with record sheets 2 and removable sheets 1 disposed in pairs. Image transfer element is provided for transferring manuscript notes 7, 7*a* from sheet 1 to sheet 2 in a pair. Each removable sheet 1 has a line of weakness 5 whereby a portion 1*a* of that sheet can be torn from a spine part 3 of the book or pad. Each portion 1*a* has on its underside surface a region 9 of low tack adhesive by which that portion can be attached temporarily to a receptive surface remote from the book. The low tack adhesive is preferably applied as a strip 8 with a width sufficient to extend from the spine part of each removable sheet 1, over the line of weakness 5, to provide the region 9 on the removable portion 1*a*.

10 Claims, 1 Drawing Sheet

RECORD BOOK OR PAD

TECHNICAL FIELD & BACKGROUND ART

The present invention relates to a record book or pad of the type having record sheets and removable sheets in overlying relationship and which are disposed alternately to provide pairs each with one record and one removable sheet. With such a known book or pad image transfer means such as carbon paper can be provided so that a marking applied by pressure to the upper sheet of a pair forms a copy of that marking on the underlying sheet of that pair. Each removable sheet usually has a line of weakness which permits that sheet to be torn from the book or pad for presentation or display, for example as a memorandum of a telephone call, at a position remote from the book or pad while a record of the marking is retained in the book or pad. With such books or pads it is not unusual for the removable sheet to be mislaid or overlooked, particularly if it is not presented prominently to the person for whom it is intended and it is an object of the present invention to provide a book or pad by which this disadvantage can be alleviated.

STATEMENT OF INVENTION & ADVANTAGES

According to the present invention there is provided a record book or pad comprising record sheets and removable sheets in overlying relationship and disposed alternately to provide pairs with a record sheet and removable sheet in each pair, each pair of sheets being arranged with image transfer means so that a marking applied by pressure to the upper sheet of a pair forms a copy of that marking on the underlying sheet of that pair; each removable sheet having a line of weakness which facilitates removal of a portion of that sheet from a spine part of the book or pad so that a marking or the copy of the marking on the removable sheet portion can be presented at a position remote from the book or pad, and wherein each removable sheet portion carries a region of low tack adhesive which is presented from the underside of that sheet portion and by which the removed sheet portion may temporarily be adhered to a receptive surface. The use of low tack adhesive is well known for paper stationery products such as message or memorandum pads of the type sold under the Trade Mark "POST IT NOTE" where the adhesive provides relatively low adhesion characteristics which permit repeated adhesive contact with and removal of a sheet from a receptive surface (such as paper, wood, metal and plastics) and which, upon removal, substantially none of the low tack adhesive is deposited on the receptive surface.

By the book or pad of the present invention it will be apparent that the removable sheet portion which, typically, will bear a manuscript note of a telephone message (or a copy of that manuscript note), when torn from the book or pad along the line of weakness (which will usually be an array of perforations) can temporarily be attached by its low tack adhesive region to a receptive surface (typically on a desk, at a position where it is prominently displayed for the person for whom the note is intended) while the record sheet in the pair which includes the removed sheet portion retains a record of the manuscript note in the book or pad.

The image transfer means may be a sheet of carbon paper which is sandwiched in conventional manner between a pair of the sheets which are to be used. Preferably however, the sheets of the record book or pad comprise paper sold under the Trade Mark "NCR" or the Trade Mark "IDEM" both of which are well known in the stationery art as requiring no carbon paper so that pressure applied by marking the upper sheet of a pair forms a copy directly on the underlying sheet of that pair. With a copying facility of the NCR or similar type as is known in the art it will be apparent that the record book or pad that can be assembled solely from a stack of record sheets and removable sheets in their respective pairs (usually the book or pad will be provided with a loose sheet of card or plastics which is positioned successively between adjacent pairs of sheets to prevent marking applied to the upper pair from passing through to the adjacent underlying pair).

The low tack adhesive is preferably in the form of a tape which is firmly secured on the underside of the removable sheet to present a low tack adhesive surface of the tape to the underlying record sheet. Alternatively the low tack adhesive can be provided on the removable sheets during manufacture of those sheets, for example by the adhesive being lightly baked on to paper sheets. When the removable sheet portion is removed from the book or pad substantially none of the low tack adhesive is deposited on the upper face of the aforementioned underlying record sheet. For the purpose of constructing the book or pad it is preferred that the low tack adhesive is applied so that it extends as a strip along a marginal edge part of each removable sheet and which marginal edge part comprises the spine part and that the strips of low tack adhesive are of sufficient width to extend from the spine part, over the lines of weakness and on to the respective removable sheet portions to form the regions of low tack adhesive on those portions. By this arrangement, the low tack adhesive along the spine part of the removable sheets assists in binding these sheets to their respective immediately underlying record sheets. With this latter arrangement in mind, it is preferred that in each pair of sheets, the upper sheet of the pair is the removable sheet while the lower sheet of the pair is the record sheet—this provides the advantage that the low tack adhesive on the underside of the upper removable sheet of a pair adhesively, albeit temporarily, restrains the removable sheet from being displaced over the associated record sheet during the application of a marking to the removable sheet so that an accurate copy of that marking may be applied to the underlying record sheet.

The book or pad formed by a stack of the sheets disposed in pairs as previously discussed may be bound together along the spine part by any suitable means known in the art, for example by an adhesive backing strip, staples, rings, clips, helical wires or springs.

Each removable sheet may be sub-divided (for example, by cut lines or perforations) into two or more coplanar sheet portions each having a line of weakness which permits that sheet portion to be torn from the spine part of the book or pad. The two or more sheet portions of a removable sheet have a single common record sheet which remains in the book or pad for record purposes. This permits efficient usage of the space available on the removable sheets and, typically, paper sheets of, say, A4 size can have three removable sheet portions which should prove adequate to accommodate a manuscript note with a telephone message.

DRAWINGS

One embodiment of a record book constructed in accordance with the present invention will now be described, by way of example only, with reference to the accompanying illustrative drawings, in which FIG. 1 is a perspective view of the book showing a removable sheet portion of a removable sheet having three such portions positioned to be torn from the book, and FIG. 2 shows an end view of the book and diagrammatically illustrates the structure of the record and removable sheets with the low tack adhesive.

DETAILED DESCRIPTION OF DRAWINGS

Figure 1:
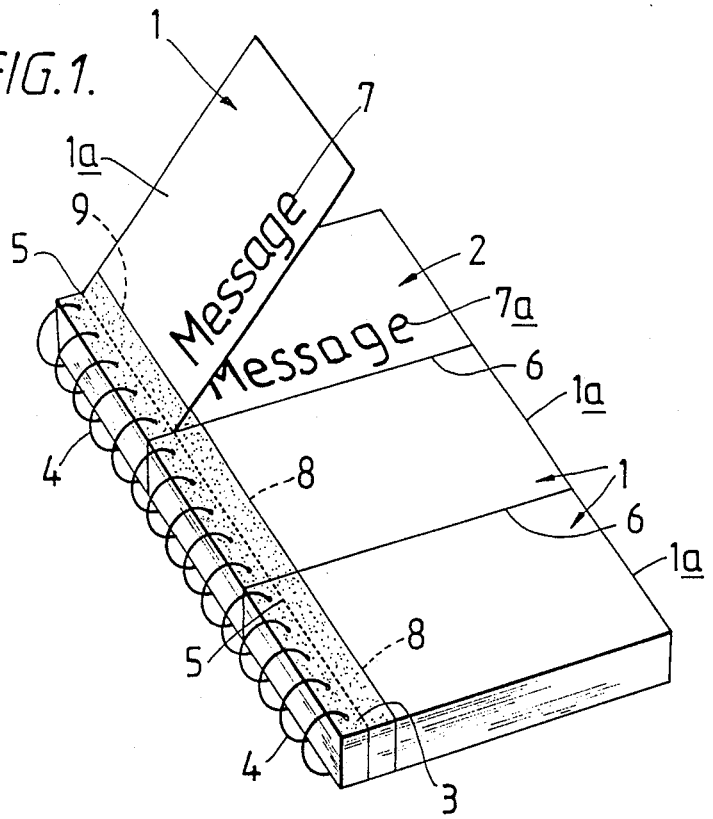

The record book illustrated is typically used for issuing memoranda or taking notes of telephone messages and comprises a stack of overlying paper sheets which consist of alternately disposed removable sheets 1 and record sheets 2. The sheets are bound together along a spine 3 by a helical wire 4 which extends parallel to an edge of the stack (for convenience the wire 4 is shown oval in FIG. 2 but normally it would be circular to facilitate opening of the book and so that the sheets may be folded back-to-back if required). Each removable sheet 1 is provided with a longitudinal line of weakness in the form of perforations 5 that extend parallel to the spine 3 and is sub-divided into three removable, equally sized, rectangular sheet portions la by parallel lateral cut or perforation lines 6. The lateral cuts 6 extend perpendicularly from the perforation line 5 to the edge of the removable sheet remote from the spine 3. By this arrangement each sheet portion la can readily be torn from the book by ripping that portion along the perforation line 5 (and, if appropriate, along a perforation line 6).

The sheets are disposed in pairs with one removable sheet 1 and one record sheet 2 in each pair and with the removable sheet 1 overlying the record sheet 2 of its pair. Furthermore, the sheets comprise material sold under the Trade Mark "NCR" or "IDEM" paper to include image transfer means whereby a marking such as a manuscript message applied by pressure to the upper surface of a removable sheet portion 1*a* is reproduced as a copy (and without the use of carbon paper) directly on the upper surface of the underlying record sheet 2 of the respective pair—such copying of a "message" is indicated at 7, 7*a*. Usually the book will be provided with a loose sheet of stiff card or plastics (not shown) which is positioned successively between the uppermost two pairs of removable and record sheets to prevent the manuscript message on the upper pair from passing through to the adjacent lower pair. The three removable portions 1*a* of a removable sheet 1 are provided with a single common record sheet 2 in the respective pair and when these removable sheet portions 1*a* are removed to present a message as required, a permanent record of the respective messages is maintained in the book as a copy on the sheets 2.

Each of the removable sheets 1 is provided with a secure strip 8 of low tack adhesive. The strip 8 is conveniently applied in the form of a tape bonded to the underside face of the removable sheet. The strip 8 extends along the marginal edge of the sheet 1 to include the spine part 3 and so that a low tack adhesive face of the strip 8 is presented towards and engages the upper face of the underlying record sheet 2 in the respective pairs of sheets. The low tack adhesive strip is co-extensive with and extends longitudinally parallel to the spine part 3 and is of sufficient width to extend laterally over the line of perforations 5 on to the portions 1*a* of the respective removable sheet 1. By this arrangement when a portion 1*a* is torn from the book along the perforation line 5 it carries with it a region 9 of low tack adhesive along an edge of its underside face. This adhesive region 9 permits the portion 1*a* to be temporarily adhered to an appropriate receptive surface so that the message on the portion 1*a* can be prominently displayed for the intended person or purpose.

The low tack adhesive characteristics of the strip 8 ensure that substantially none of the adhesive is deposited on a record sheet when an immediately overlying removable sheet portion 1*a* is torn from the book.

Figure 2:
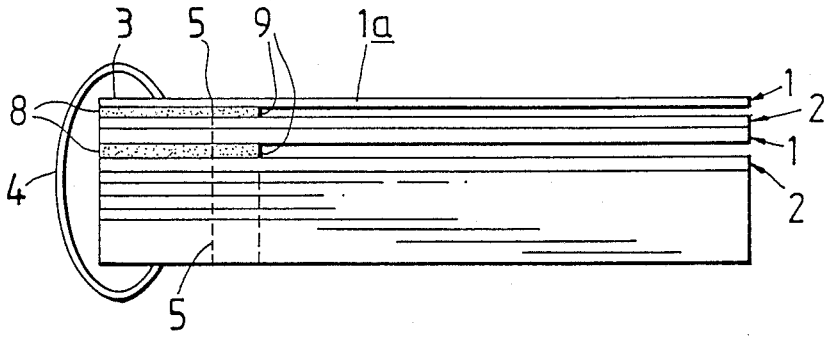

It will be noted from FIG. 2 that each adhesive strip 8 is sandwiched between the record sheet and removable sheet in a respective pair so that the sheets in a pair are bound together (albeit in a non-permanent manner) by the adhesive characteristics of the strip 8. This has the advantage of alleviating relative displacement between the sheets 1 and 2 in a pair, for example while a message or other marking is being applied to the removable sheet 1 so that that message may be reproduced clearly on the underlying record sheet 2.

The pairs of sheets 1 and 2 are conveniently bound together solely by the helical wire 4 or other form of conventional binding but, if required, adhesive can be provided along the spine part 3 between adjacent overlying record and removable sheets of adjacent pairs of such sheets.

The record book is conveniently manufactured by applying the strip of low tack adhesive tape to the underside marginal edge surface of each removable sheet 1 and thereafter cutting or otherwise forming the line of perforations 5 and cut lines 6 in the removable sheets prior to binding the sheets 1 and 2 together. In this way the low tack adhesive strip 9 is perforated and cut so that each portion 1*a* can readily be torn from the book.

As an alternative to applying the low tack adhesive in tape form as mentioned above, the adhesive can be applied during collation of the sheets. By this technique, two continuous webs (not shown) can collate sheets 1 and 2 and at the point at which these two webs meet a nozzle introduces adhesive between these sheets in the form of a continuous line. The two webs are then pressed together and the adhesive bonds the marginal edges of the pages together to provide the required low tack adhesive characteristics.

I claim:

1. A record book comprising record sheets and removable sheets in overlying relationship, said sheets being disposed alternately to provide pairs with a said removable sheet overlying a said record sheet in each pair; each sheet having a longitudinally extending spine part adjacent to a common edge of the book; binding means engaging through the spine parts of said pairs of sheets for permitting each successive pair of sheets to be moved about said binding means from a position at the front of the book to a position at the back of the book; each said removable sheet having a longitudinally extending line of weakness adjacent to the spine part thereof which facilitates removal of a portion of that sheet from the spine part; image transfer means associated with each pair of sheets for transferring a marking applied by pressure to said removable sheet portion to form a copy of said marking on the underlying record sheet; low tack adhesive carried by each said removable sheet contacting the record sheet with which that removable sheet is paired, said low tack adhesive extending longitudinally on each removable sheet adjacent to the line of weakness of that sheet on both the spine part and the portion of the sheet which is to be removed whereby said portion, when removed, can temporarily be adhered by the low tack adhesive thereon to a surface remote from the book and the low tack adhesive on the spine part which remains on the removable sheet adheres that spine part to the spine part of the record sheet in its pair.

2. A book as claimed in claim 1 in which said low tack adhesive comprises a longitudinally extending strip on each removable sheet, said strip having a lateral width which is sufficient to extend from the spine part, over the line of weakness and onto the portion of its removable sheet which is to be removed.

3. A book as claimed in claim 1 in which each said removable sheet is sub-divided, by divisions which extend perpendicularly relative to the spine part, into at least two co-planar sheet portions, each said sheet portion having said line of weakness which permits that sheet portion to be torn from the spine apart and having low tack adhesive thereon.

4. A book as claimed in claim 3 in which the sheet portions of each removable sheet have a single common record sheet.

5. A book as claimed in claim 1 in which the binding means comprises a spiral binding.

6. A book as claimed in claim 1 in which the binding means comprises a ring binding.

7. A method of manufacturing a record book comprising record sheets and removable sheets each having a spine part which comprises forming a longitudinally extending line of weakness in each removable sheet between the spine part and a removable portion of that sheet; pairing in overlying relationship and with their spine parts adjacent to a common edge, each removable sheet with a record sheet; applying low tack adhesive to each removable sheet to contact the record sheet with which it is paired, said low tack adhesive being located to extend longitudinally on each removable sheet adjacent to the line of weakness thereof on both the spine part and the removable portion of that sheet; arranging the pairs of sheets in overlying relationship with the removable sheet overlying the record sheet in each pair; binding the pairs together by binding means which extends through the spine parts so that each successive pair of sheets can be turned about said binding means from a position at the front of the book to a position at the back of the book, and applying image transfer means for each pair of sheets whereby a marking applied by pressure to said removable sheet portion of each pair forms a copy of said marking on the underlying record sheet of that pair.

8. A method as claimed in claim 7 which comprises applying said low tack adhesive as a longitudinally extending strip on the removable sheet, said strip having a lateral width which is sufficient to extend from the spine part, over the line of weakness and onto the removable portion of that removable sheet.

9. A method as claimed in claim 7 which comprises forming the line of weakness in the removable sheet prior to applying the low tack adhesive thereto.

10. A method as claimed in claim 7 which comprises applying the low tack adhesive between the record sheet and removable sheet in each pair simultaneously with the pairing of said sheets.

* * * * *